US005993108A

United States Patent [19]

Buhman

[11] Patent Number: 5,993,108

[45] Date of Patent: Nov. 30, 1999

[54] DOWELL ROD INSERTER

[75] Inventor: Gerald L. Buhman, St. Joseph, Mo.

[73] Assignee: Bestgen, Inc., St. Joseph, Mo.

[21] Appl. No.: 09/131,542

[22] Filed: Aug. 10, 1998

[51] Int. Cl.[6] ..... E01C 23/04

[52] U.S. Cl. ..... 404/88; 404/100; 249/2

[58] Field of Search ..... 404/98, 88, 100; 249/2, 4, 8, 9

[56] References Cited

U.S. PATENT DOCUMENTS

| | | | |
|---|---|---|---|
| 1,982,387 | 11/1934 | Heltzel . | |
| 2,134,641 | 10/1938 | Mundt . | |
| 2,142,294 | 1/1939 | Westland . | |
| 2,295,947 | 9/1942 | Heltzel . | |
| 2,389,773 | 11/1945 | Golden | 404/88 |
| 2,399,025 | 4/1946 | Heltzel . | |
| 3,068,766 | 12/1962 | Houck . | |
| 3,572,226 | 3/1971 | Rasmussen . | |
| 3,853,444 | 12/1974 | Jones | 404/100 |
| 4,168,135 | 9/1979 | Johansson et al. | 404/100 |
| 4,298,293 | 11/1981 | Baucom | 404/98 |
| 4,312,602 | 1/1982 | Dale | 404/100 |
| 4,433,936 | 2/1984 | Moser | 404/88 |
| 4,636,110 | 1/1987 | Augoyard | 404/100 |
| 4,688,963 | 8/1987 | Ritchey et al. | 404/72 |
| 4,798,495 | 1/1989 | Laeuppi et al. | 404/100 |
| 4,799,820 | 1/1989 | Laeuppi et al. | 404/100 |
| 5,173,005 | 12/1992 | Henderson et al. | 404/98 |
| 5,190,397 | 3/1993 | Bengford et al. | 404/88 |
| 5,209,602 | 5/1993 | Godbersen | 404/88 |
| 5,273,374 | 12/1993 | Thoma et al. | 404/88 |
| 5,318,377 | 6/1994 | Swisher, Jr. et al. | 404/74 |
| 5,354,189 | 10/1994 | McKinnon | 425/64 |
| 5,405,212 | 4/1995 | Swisher, Jr. et al. | 404/74 |
| 5,527,129 | 6/1996 | McKinnon | 404/98 |
| 5,662,431 | 9/1997 | Colvard | 404/105 |
| 5,678,952 | 10/1997 | Shaw et al. | 404/62 |

*Primary Examiner*—Robert Pezzuto
*Assistant Examiner*—Kristine N. Markovich
*Attorney, Agent, or Firm*—Woodard, Emhardt, Naughton Moriarty & McNett

[57] ABSTRACT

A device for inserting rods into plastic forms comprising a frame, a plunger assembly coupled to the frame, an air cylinder assembly also coupled to the frame and to the plunger assembly, and a pneumatic plumbing assembly connected to the air cylinder assembly. The frame can be attached to a slipform paving or curbing machine. When actuated, the air cylinder assembly pulls the plunger along the frame. The plunger pushes a dowel rod resting in the frame along the frame and into a concrete member being extruded from the machine.

10 Claims, 5 Drawing Sheets

DOWELL ROD INSERTER

TECHNICAL FIELD OF THE INVENTION

The present invention relates generally to road construction, and more specifically to a dowel rod inserter attachment for a curbing or paving machine.

BACKGROUND OF THE INVENTION

It is well known among civil engineers that dowel rods facilitate the connection of concrete members. Dowel rods are partially inserted into a first concrete member, such as a curb or road slab, that is to later be adjoined to a second concrete member. As the first form cures, the rods become partially embedded. When the second form is poured, the ends of the dowel rods protruding from the first form are encased by the fresh concrete of the second form and become embedded therein as it hardens. The embedded dowel rods thusly join the first and second concrete members. In the case of concrete curbing poured to be later adjoined to the road or street, dowels about ½ inch in diameter and about 30 inches long are inserted by half their lengths into the freshly poured curbing. When the roadway is later poured, the rods become embedded and serve to firmly fasten the roadway to the curbing.

Concrete slabs and curbing are commonly poured by slipform paving machines. Paving machines are tractors that extrude concrete slabs with cross sectional shapes determined by the shape of the auger mouth or the vertical sideforms and screed. Slipform paving machines typically extrude curbing from a set of sideforms and screed, which form the concrete into the curb shape as it is extruded. The viscosity of the concrete is such that it retains its extruded shape as the curbing machine advances.

Traditionally, the dowel rods have been inserted into the freshly poured curbing by hand. This process has several disadvantages. First, the rods may not be inserted at regular intervals, at regular heights, or to regular depths. Also, additional manpower is required, not only to insert the rods but also to finish the concrete since rod insertion after pouring causes a bulge or ripple distortion in the fresh concrete. Finally, manual insertion and finishing operations are tedious, time consuming, and inefficient utilizations of manpower resources.

There have also been attempts to design mechanized dowel rod inserters to be used with slipform pavers. These too suffer drawbacks. The prior inserters are complex, bulky and cumbersome. Also, the prior inserters are inconsistent with respect to insertion angle, depth, and spacing. Furthermore, some prior inserters have been designed to trail the paver, necessitating a finishing step for the concrete member after rod insertion. Moreover, trailing inserters cannot accommodate even moderate changes in direction or elevation of the paver. If the paver turns too sharply, the inserter will be pulled into the freshly poured concrete member. Hence, there is a need for an improved dowel rod insertion device for use with a slipform paver. A means for satisfying this need has so far eluded those skilled in the art.

SUMMARY OF THE INVENTION

The present invention relates generally to street or road construction, and more specifically to a dowel rod inserter attachment for a curbing or paving machine. In one embodiment of the present invention a pair of pneumatic cylinders are mounted on a frame and can be actuated to pull a rod resting in a trough in the frame into a freshly poured concrete member. One object of the present invention is to eliminate the need for post-extrusion finishing of the concrete member by providing means for inserting rods into the concrete member prior to extrusion. Related objects and advantages of the present invention will be apparent from the following description.

DETAILED DESCRIPTION OF THE PREFERRED EMBODIMENT

Figure 1:
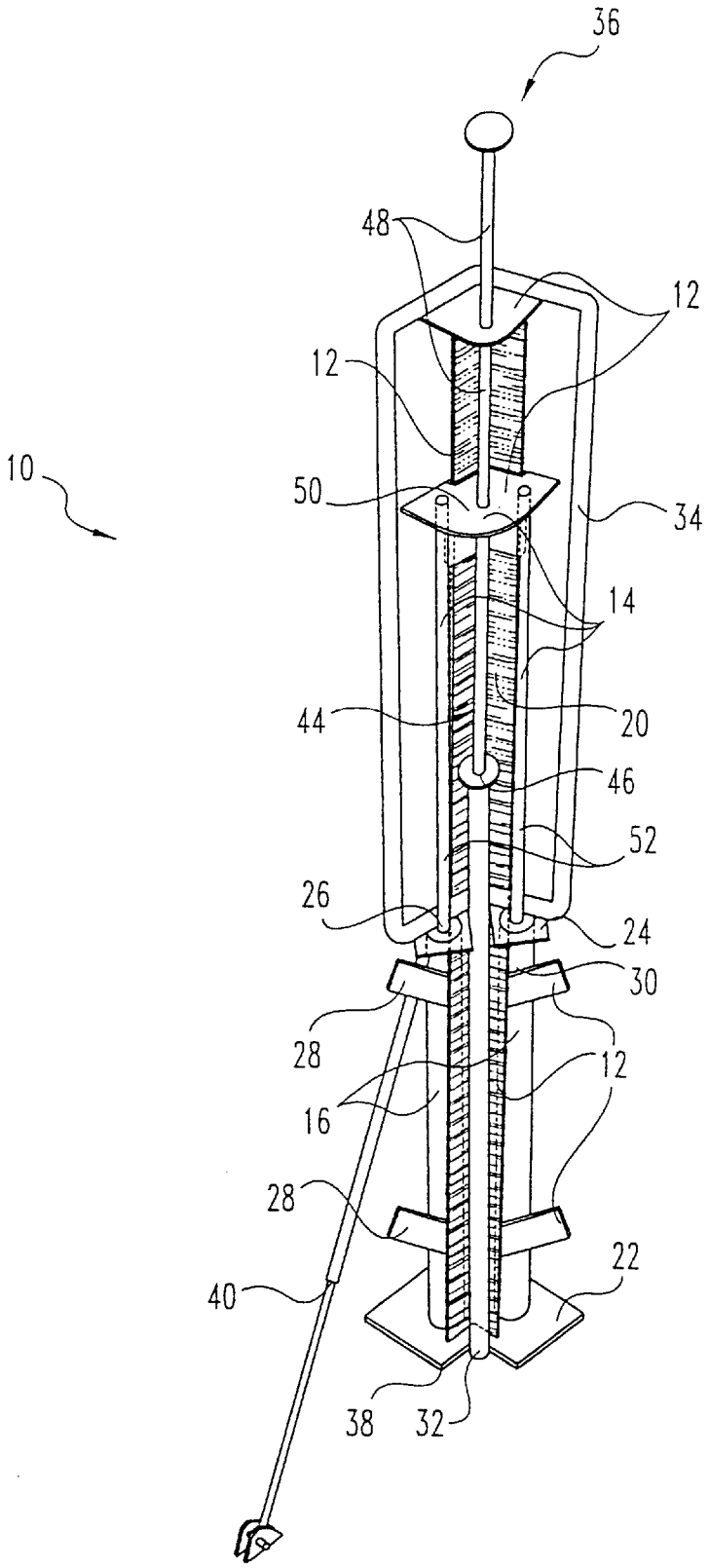
FIG. 1 is a front view of one embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
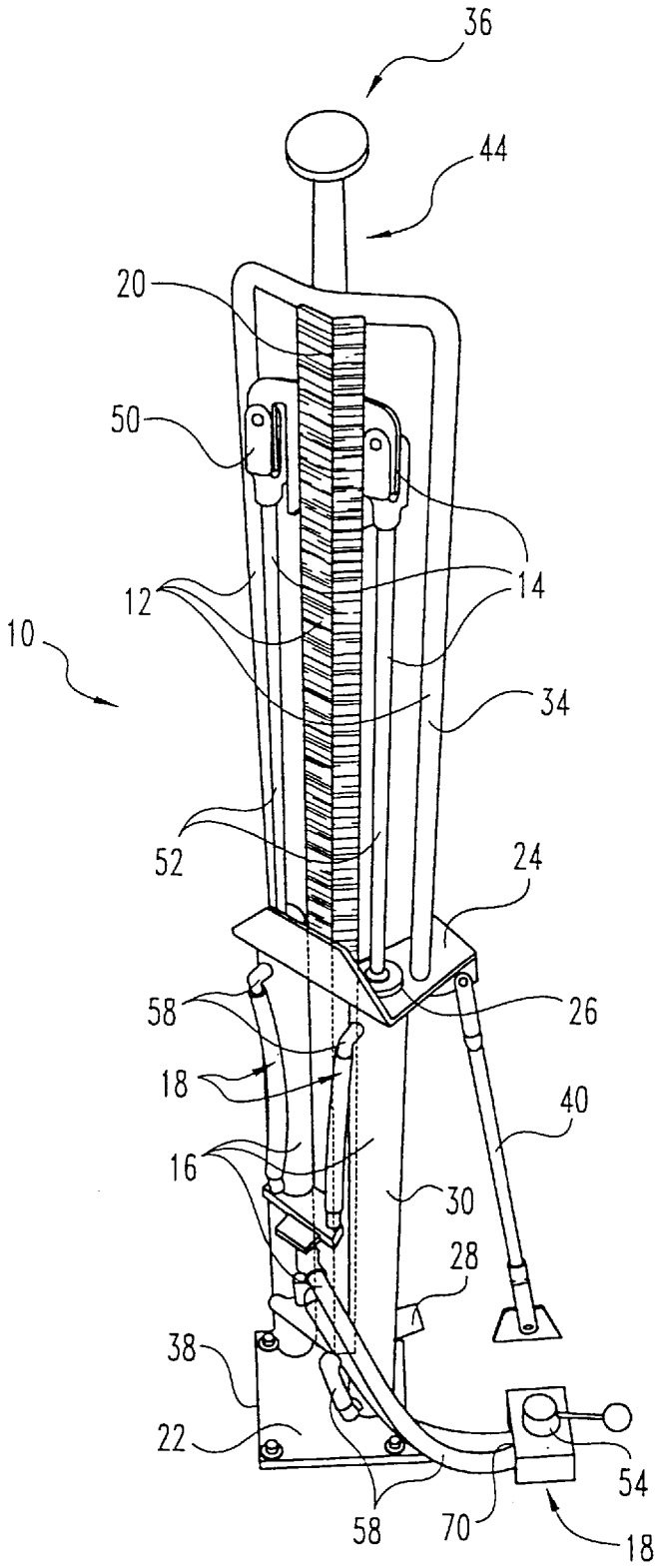
FIG. 2 is a rear view of one embodiment of the present invention.

Referring to FIGS. 1 and 2, a preferred embodiment dowel rod insertion device 10 is shown. The dowel rod insertion device 10 comprises a frame 12, a sliding plunger assembly 14, an air cylinder assembly 16, and a pneumatic plumbing assembly 18. In one preferred embodiment, the frame 12 is a steel skeleton having a V-shaped member 20 and terminating at one end in a foot 22. The V-shaped member 20 preferably comprises two flat, elongated rectangular strips joined to form an elongated trough with a V-shaped cross-section. One end of the V-shaped member 20 is connected to the foot 22. The foot 22 is oriented perpendicular to the V-shaped member 20 and is adapted to be boltedly coupled to a machine, such as a slipform paving or curbing machine (see FIGS. 3 and 4).

The frame 12 has a collar 24 located about halfway along its length. The collar 24 in the preferred embodiment has two apertures 26 therein, although in other embodiments the number of apertures 26 vary. The frame 12 also has a plurality of wings 28 extending from the V-shaped member 20. In one preferred embodiment, the wings 28 are provided symmetrically in pairs extending outwardly from the V-shaped member 20, although they may be provided in any convenient arrangement. Other embodiments have no wings. In this preferred embodiment, a first pair of wings 28 is located near the foot 22 and a second pair of wings 28 is located near the collar 24. The wings 28 lie in the planes defined by the respective sides of the V-shaped member 20 and aid in holding the air cylinders 30 in place as well as in guiding the dowel rods 32 into the V-shaped member 20.

A handle member 34 extends from the collar 24 parallel to the V-shaped member 20 to the free end 36 of the frame 12 (opposite the foot end 38), across the free end 36, and back down the frame 12 to the collar 24. In this preferred embodiment, the handle member 34 is formed of steel tubing, although the handle member 34 may be formed from any suitable structural material.

In this preferred embodiment, an angle-stabilizing rod 40 is attached at one end to the collar 24 and is adapted to be coupled at its opposite end to the paving or curbing machine. By adjusting the length of the angle-stabilizing rod 40 and the point of connection to the machine, the angle of insertion of the dowel rods 32 into the wet, plastic concrete member 42 may be precisely controlled. In the preferred embodiment, the concrete member 42 has the shape of extruded curbing; however, the concrete member 42 may have any shape. The angle-stabilizing rod 40 also adds structural support to the dowel rod insertion device 10 when coupled to a machine. In this preferred embodiment, the angle-stabilizing rod 40 is formed of steel, although any suitable material may be used.

The sliding plunger assembly 14 of this preferred embodiment of the present invention comprises a plunger 44 with a plunger head 46 and an elongated plunger body 48 coupled to a sled 50 adapted to slide in the trough of the V-shaped member 20. The sled 50 is coupled to the plunger 44 about midway along its elongated body 48. In this preferred embodiment, the sled 50 and plunger 44 are formed from steel, although any suitable material may be used.

The air cylinder assembly 16 of this preferred embodiment of the present invention comprises a pair of pneumatic air cylinders 30 mounted in the frame 12 parallel to the lengthwise direction of the elongated V-shaped member 20. The air cylinders 30 are coupled to the foot 22, run along the exterior of the V-shaped member 20, and are coupled to the collar 24. The pistons 52 of the air cylinders 30 protrude through the apertures 26 in the collar 24 and are coupled to the sled 50. In this preferred embodiment, there are two apertures 26 in the collar 24, both adapted to be wide enough to pass the pistons 52. Embodiments are envisioned using more pneumatic cylinders 30 oriented symmetrically about the frame 12. Embodiments using more pneumatic air cylinders 30, and therefore more pistons 52, would have enough apertures 26 arranged to accommodate the number of pistons 52 used. Extension of the pistons 52 pushes the sled 50 and plunger 44 toward the free end 36 of the frame 12. Retraction of the pistons 52 pulls the sled 50 and plunger 44 towards the foot 22 end of the frame 12.

Figure 3:
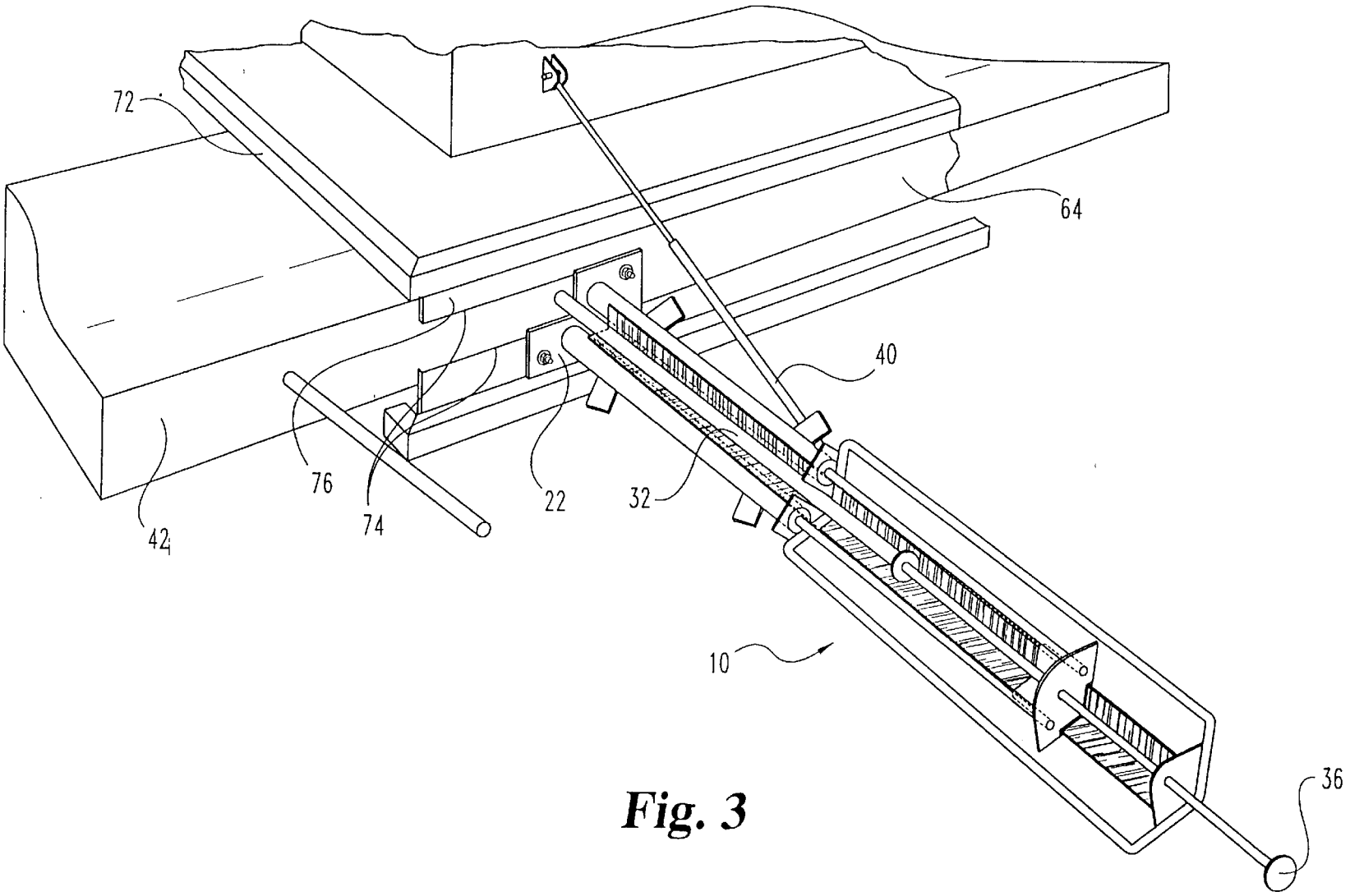
FIG. 3 is a front perspective view of one embodiment of the present invention as attached to a slipform paving machine.
Figure 4:
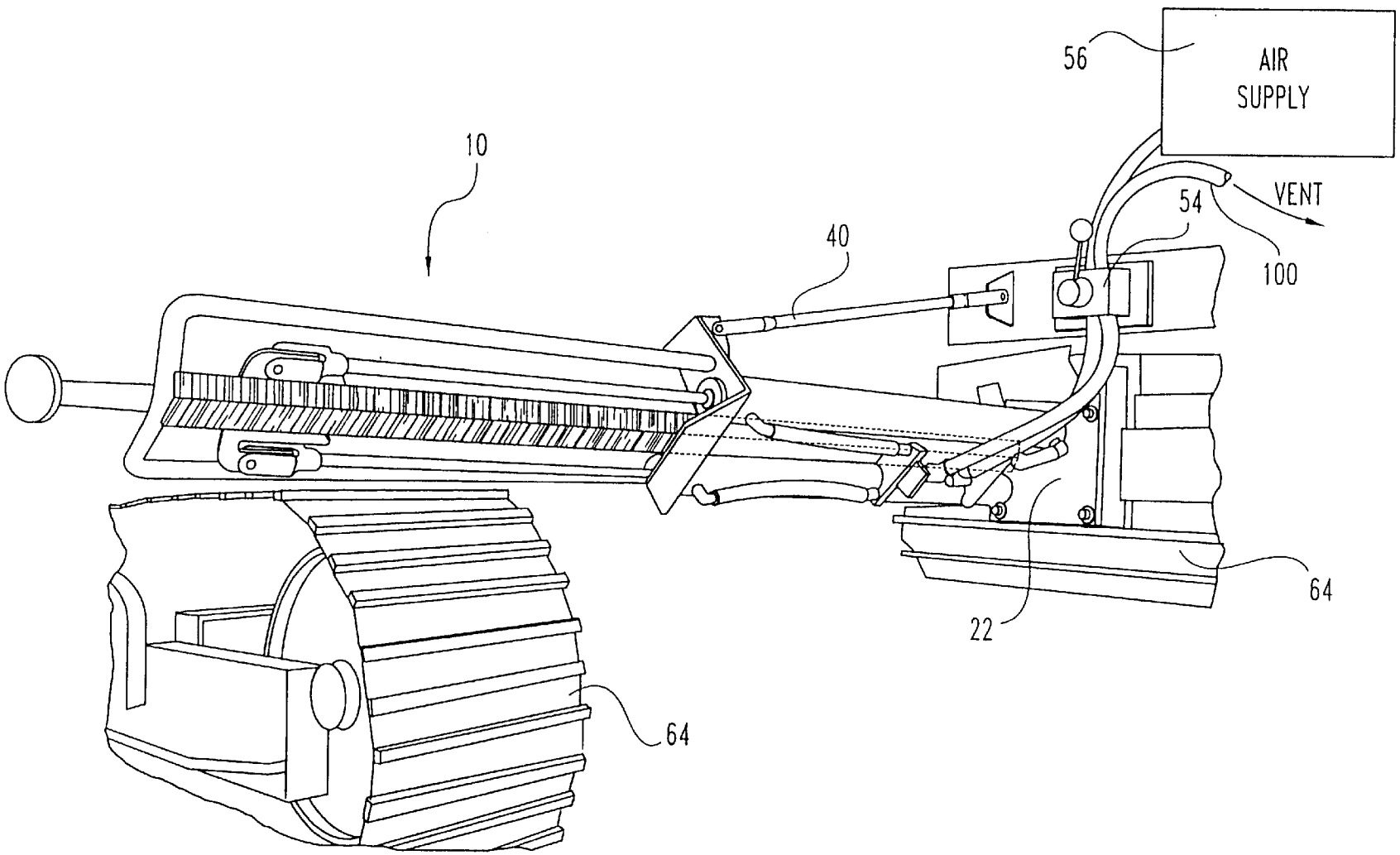
FIG. 4 is a rear perspective view of one embodiment of the present invention as attached to a slipform paving machine.

FIGS. 3–4 illustrate the dowel rod insertion device 10 as attached to a slipform curbing machine 64, such as a Gomaco Commander III Trimmer/Paver. The foot 22 is attached to the machine 64, anterior to the extrusion port 72 from which the concrete member 42 is emerging. A slot 74 has been cut in the wall 76 of the extrusion port 72 to accommodate the insertion and release of the dowel rods 32. The angle-stabilizing rod 40 extends from the collar 24 portion of the dowel rod inserter 10 to the curbing machine 64.

In this preferred embodiment, the dowel rod inserter 10 is mounted just ahead of the extrusion port 72 through which the fresh concrete member 42 leaves the machine. In this preferred embodiment the foot 22 is boltedly connected to the side of the machine 64. In other embodiments, and convenient means, such as welding, may be used to attach the dowel rod insertion device 10 to the machine 64. The dowel rod insertion device 10 is mounted proximate to the internal vibrators (not shown), so that dowel rod 32 is inserted into the concrete member 42 prior to its extrusion from the machine 64. The vibrators smooth out any disturbances in the plastic concrete member 42 made by the insertion of the dowel rods 32 before the concrete curb member 42 exits the machine 64. Therefore, the concrete curb member 42 as extruded requires no additional finishing steps to remove distortions produced by the insertion of the dowel rods 32.

In operation, a dowel rod 32 is loaded into the trough of the V-shaped member 20. Retraction of the pneumatic pistons 52 pulls the plunger 44 against a dowel rod, thereby pushing the dowel rod 32 into the concrete curb member 42 as it is being extruded. In the preferred embodiment of the present invention different two pneumatic air cylinders 30 are used to actuate the insertion of the dowel rods 32 into the concrete member 42; however, other embodiments may require other numbers of air cylinders 30 to actuate the insertion of the dowel rods 32 into the member 42.

Figure 5:
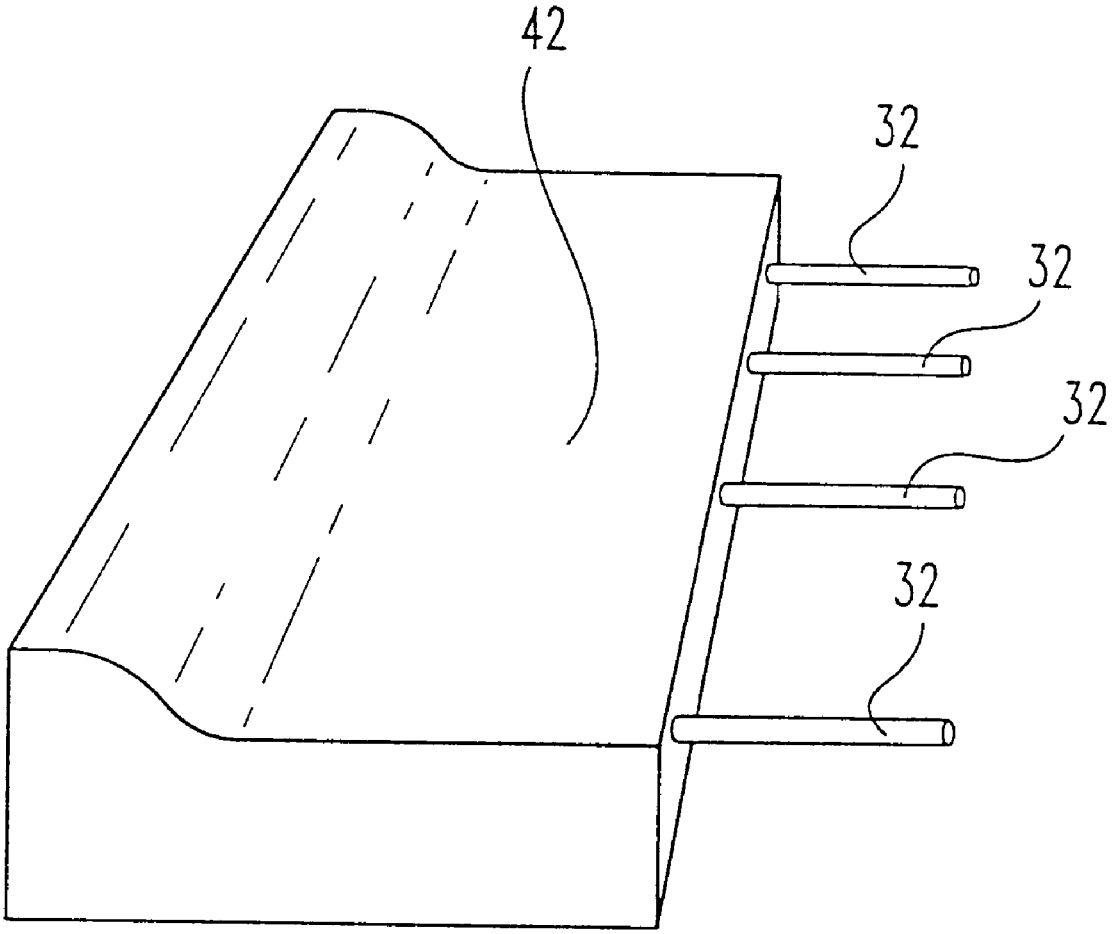
FIG. 5 is a perspective view of rods protruding from a section of concrete curbing.

FIG. 5 is an illustration of a section of extruded member 42 into which dowel rods 32 have been inserted. The dowel rods 32 protrude from the concrete member 42 and are adapted to receive paving material. Upon solidification of the roadway, the dowel rods 32 interlock the concrete curb member 42 to the roadway and prevent separation.

The pneumatic plumbing assembly 18 of this preferred embodiment connects the pneumatic air cylinder assembly 16 to a control actuator 54 and the compressed air source 56. The plumbing assembly 18 comprises a set of rubber air hoses 58, a control actuator switch 54, and a compressed air source 56 capable of providing a constant supply of air pressure sufficient to actuate the periodic insertion of dowel rods 32 into the concrete 42 as it is being extruded.

The primary compressed air source 56 in this preferred embodiment of the present invention is the slipform curbing or paving machine 64 that the dowel rod insertion device 10 is coupled to. However, any conventional air compressor capable of generating sufficient pressure to retract the pistons 52 may be used. An auxiliary air reserve tank (not shown) may be operationally connected to the system if the compressed air supply 56 is insufficient to actuate the insertion of dowel rods 32 at the desired frequency. Rubber air hoses 58 are operationally connected at one end to the compressed air source 56 and vent 100, and at the other to the actuator switch 54. Other rubber air hoses 58 are operationally connected at one end to the first and second cylinder ports 70 of the actuator switch 54 and at the other end, respectively, to the first and second air cylinders 30. In this preferred embodiment, barb fittings, brass elbows, and hose clamps (not shown) are used in the connection of the hoses 58. The actuator switch 54 of this preferred embodiment is a control valve rotary disc. In this preferred embodiment, the actuation of the dowel rod 32 insertion is manually controlled. In other embodiments, the insertion of the rods 32 may be automatically actuated by a microswitch solenoid and spring finger (such as manufactured by Omron, available through Grainger Catalog No. 388, part no. 3A096, p. 568), a multidirectional spring wire wobble and direct acting solenoid valve pair (such as ARO parts no. CAT 33P-012-D and CAT 44P-012-D, available through Grainger Catalog 388, parts no. 2G485 and 2G497), or the like. Likewise, in this preferred embodiment, the operator manually loads the rods into the V-shaped member 20. In other preferred embodiments, the rods may be loaded into a hopper and automatically dropped into the V-shaped member 20 through the use of a sensor actuating a solenoid gate or the like. The dowel rods 32 are usually iron or steel rods about 0.5 inches in diameter and about 3 feet in length, although these dimensions may vary greatly with the requirements of the application.

What is claimed is:

1. A dowel rod insertion device comprising:

a frame adapted to hold a dowel rod and adapted to be coupled to a concrete extrusion machine;

a plunger assembly slidingly coupled to the frame;

an air cylinder assembly coupled to the frame comprising:
a collar having a plurality of apertures; and
an air cylinder having a piston wherein the piston extends through one of the collar apertures and couples to the sliding plunger assembly; and a pneumatic plumbing assembly coupled to the air cylinder assembly comprising:
a compressed air source;
an actuator switch; and
hoses operationally coupling the compressed air source to the actuator switch and the actuator switch to the air cylinders;

wherein actuation of the air cylinders causes the pistons to pull the plunger into the rod, thereby pushing the rod into the extruded concrete.

2. The dowel insertion device of claim 1 wherein the frame is formed from steel.

3. The dowel insertion device of claim 1 wherein the frame further comprises a V-shaped member.

4. The dowel rod insertion device of claim 3 wherein the sliding plunger assembly is adapted to slide in the V-shaped member.

5. The dowel rod insertion device of claim 1 wherein the air cylinder has a bore of about 1.5 inches and a inch stroke of about 16 inches.

6. The dowel rod insertion device of claim 1 further comprising an insertion angle-stabilizing rod coupled to the frame and the concrete extrusion machine.

7. The dowel rod insertion device of claim 1 further comprising an auxiliary compressed air source operationally coupled to the pneumatic plumbing assembly.

8. The dowel rod insertion device of claim 1 further comprising a plurality of air cylinders operationally coupled to the frame and to the plunger assembly.

9. A rod inserter comprising, in combination:

a frame;

a plunger assembly coupled to the frame;

an air cylinder assembly operationally coupled to the frame and the plunger assembly; and a pneumatic plumbing assembly connected to the air cylinder assembly;

wherein the frame has a foot end adapted to be connected to a concrete pouring machine and an oppositely disposed free end; and wherein the air cylinder assembly comprises a plurality of pneumatic cylinders symmetrically disposed about the frame, having pistons extending towards the free end of the frame and connected to the plunger assembly.

10. A rod insertion device comprising:

a frame having:
a V-shaped member;
a foot; and
fasteners adapted to couple the device to a paver;

a sliding plunger assembly operationally connected to the frame and adapted to slide in the V-shaped member, having:
a plunger having a head and an elongated cylindrical body;
a sled coupled to the plunger;

an air cylinder assembly coupled to the frame, having:
a collar having apertures;
a plurality of air cylinders having pistons wherein the pistons extend through respective apertures and couple to the sled; and a pneumatic plumbing assembly coupled to the air cylinder assembly, having;
a compressed air source;
an actuator switch; and
hoses operationally coupling the actuator switch to the compressed air source and the air cylinders.

* * * * *